United States Patent [19]

Watanabe et al.

[11] Patent Number: 4,467,248

[45] Date of Patent: Aug. 21, 1984

[54] VARIABLE ELECTRONIC FLASH LIGHT EQUIPMENT

[75] Inventors: Koji Watanabe; Michio Yagi, both of Hachioji, Japan

[73] Assignee: Konishiroku Photo Industry Co., Ltd., Tokyo, Japan

[21] Appl. No.: 252,456

[22] Filed: Apr. 9, 1981

[30] Foreign Application Priority Data

Apr. 9, 1980 [JP] Japan ..... 55-47119[U]
Apr. 9, 1980 [JP] Japan ..... 55-47120[U]

[51] Int. Cl.[3] ..... H05B 41/32

[52] U.S. Cl. ..... 315/241 P; 315/240; 320/1

[58] Field of Search ..... 315/240, 241 P, 241 R; 354/145; 355/69; 320/1

[56] References Cited

U.S. PATENT DOCUMENTS 3,725,734 4/1973 Schneider ..... 315/241 P 4,255,046 3/1981 Corona ..... 315/241 P X

*Primary Examiner*—Eugene R. LaRoche

*Attorney, Agent, or Firm*—Jordan B. Bierman; Linda Bierman

[57] ABSTRACT

A variable illumination flash apparatus includes a main capacitor in parallel with a flash lamp and power source for normally supporting triggered discharge illumination of the lamp. A plurality of secondary circuits each containing a series-connected silicon controlled rectifier and secondary capacitor are disposed in parallel with the main capacitor and are individually selectively actuatable to store additional electric charge for further supporting lamp illumination. Each secondary circuit is actuated only when additional illumination is required for a subequent flash operation, thereby promoting efficient conservation of the power source in that no power is drawn from the source and stored in the capacitors unless needed for the immediately subsequent flash operation.

2 Claims, 3 Drawing Figures

VARIABLE ELECTRONIC FLASH LIGHT EQUIPMENT

BACKGROUND OF THE INVENTION

1. Field of the Invention

The present invention relates to an improvement of an electronic flash light equipment which makes its flash light quantity variable.

2. Description of the Prior Art

With respect to an electronic flash light equipment, wherein, for the purpose of avoiding any wasteful consumption of flashing energy, a plurality of main capacitors are provided in parallel to a gas-charged flash lamp and the quantity of flash light is changed stepwise by controlling the number of said main capacitors which takes part in flash luminescence, such arrangements are well known in the Japanese Patent Examined Publication Nos. 12196/1976 and 11290/1967, for example. However, those of the conventional technology have problems such as requiring circuit wiring that is complicated, or having the charged main capacitors not taking part in an electric discharge whereby the electric energy loss increases.

SUMMARY OF THE INVENTION

It is an object of the present invention to provide a variable electronic flash light equipment which has none of such abovementioned problems, but in which the circuit wiring can be made comparatively simple, and in which the energy loss is decreased.

Other and further objects, features and advantages of the invention will appear more fully from the following description.

DETAILED DESCRIPTION OF THE PREFERRED EMBODIMENTS

Figure 1:
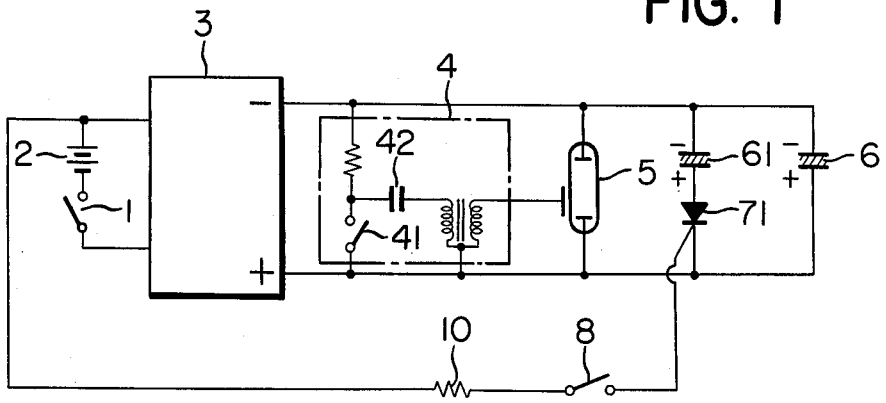
FIG. 1 is a circuit diagram of an equipment of the invention whose flash light quantity is variable two-stepwise.
Figure 2:
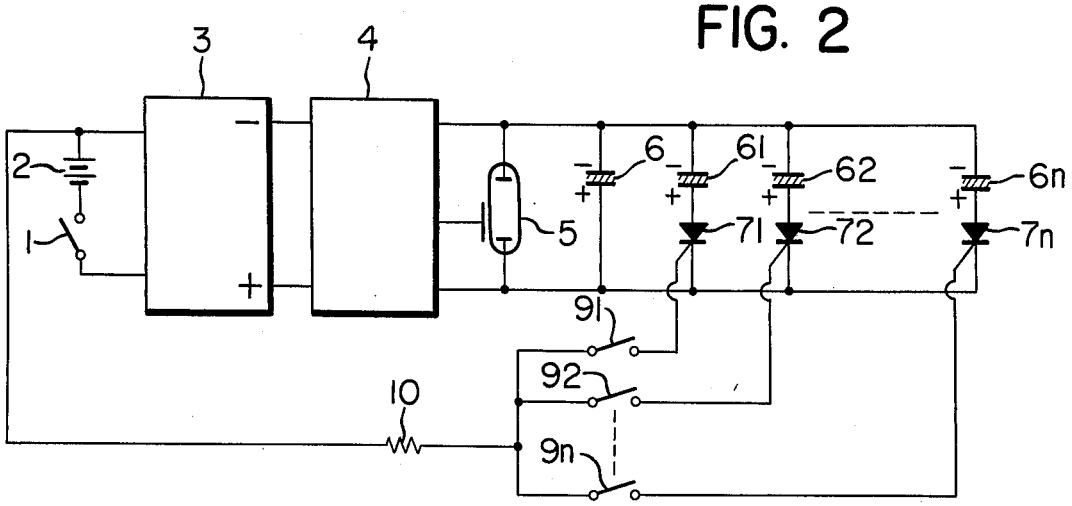
FIG. 2 is a circuit diagram wherein the variable steps of the flash light quantity are increased.

Referring to the drawings of the invention, FIG. 1 is a circuit diagram of an electronic flash light equipment of the invention of which the quantity of the flash light is made variable dual-stepwise; FIG. 2 is a circuit diagram, wherein the number of the variable steps of the flash light quantity is increased; and FIG. 3 is a characteristic chart of a silicon controlled rectifier.

In FIG. 1 and FIG. 2, the numeral 1 designates a main switch; 2 is an electric power source, that is a battery; 3 is a DC-DC converter by which the power source of step-up direct current for the electronic flash circuit is provided by stepping up the voltage of said electric power source 2; 4 is a trigger circuit for discharging a gas-charged flash lamp 5 and includes a trigger switch 41 and a capacitor 42 for generating a trigger voltage; 6, 61, **62–6*n* are main and secondary capacitors respectively for the storing an electric charge of gas-charged flash lamp 5 to discharge the same for flash luminescence; 71, 72–7*n* are the electronic switches in the form of silicon controlled rectifiers (SCR) respectively provided in the parallel circuits of said secondary capacitors 61, 62–6*n*. In other word, one or more circuits comprising an electronic switch and a secondary capacitor connected in series with one another are arranged in parallel to the gas-charged flash lamp in FIG. 1, with circuits to the number of n arranged in parallel to the gas-charged flash lamp in FIG. 2. The numerals 8 and 91, 92–9*n* refer to selective switch means which connect said electronic switches 71, 72–7*n*; 10 is a resistor provided in series with the selective switch means 8 or 9; and said battery is connected to the gate of the SCR through the resistor 10** and the appropriate selective switch.

When applying current from the power source battery 2 through the main switch 1, DC-DC converter 3 is energized, and capacitor 42 for generating trigger voltage and at least main capacitor 6 are charged, and when trigger switch 41 is on, the gas-charged flash lamp can be discharged to make a flash. To make the flash luminescence quantity of said gas-charged flash lamp variable, it can be done by closing the desired switch(es) 8, 91, **92–9*n* as occasion demands. That is to say, when said selective switch means are switched on, a voltage signal is applied to said electronic switch 71, etc. from the power source battery 2, and therefore the electronic switch 71, etc. come in the on state whereby a charging current is made flow to the secondary capacitors 61, etc. and charges them, and then effect flash discharge of said gas-charged flash lamp 5 similar to the case of main capacitor 6**.

Figure 3:
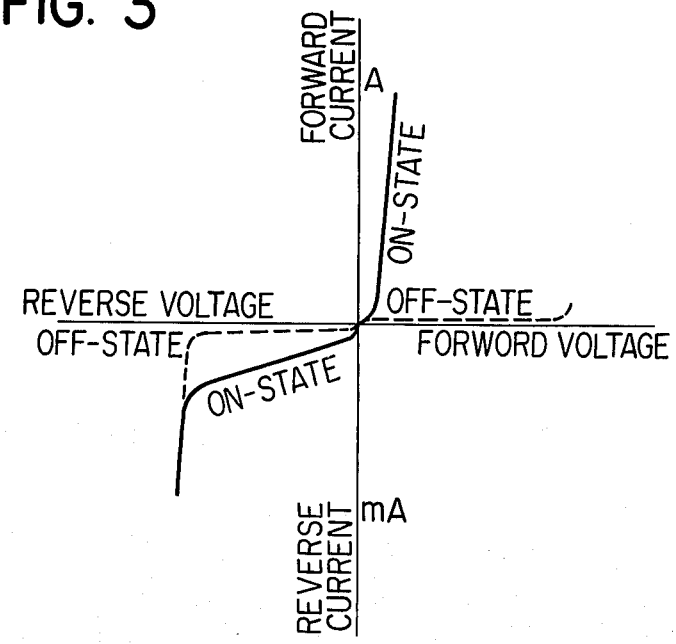
FIG. 3 is a characteristic chart of a silicon controlled rectifier.

When the SCRs are switched on, the resistance of each SCR will become less when the discharge currents of secondary capacitors 61, **62–6*n* flow as forward currents, but when the SCRs are switched off, as is shown in the characteristic chart of FIG. 3, substantially no reverse current will flow i.e., as little as the order of 10 $\mu$A, therefore the secondary capacitors are not charged. But when the SCRs are switched on, the reverse current of the order of several mA will flow, and thereby said secondary capacitors are satisfactorily charged; in addition, the switching-on and off operation can be done stably, simply and surely which is the reason why the SCRs are used for electronic switches 71, 72–7*n*** in the examples given. In other words, owing to the usage of SCRs, one can eliminate the problems such as a contact fault as is caused in a mechanical current-interruption switches or the like, and the circuit wiring in the equipment of the invention is simplified compared to that in the other types of electronic switches such as the one using transistors.

As is obvious from the above description, the electronic switches 71, etc. which are switched out by the selective switch means 8 or 91, **92–9*n*, will remain in the switching-off state, and the capacitors 61**, etc. will not be charged; therefore the other capacitors not taking part in a flash discharge will not even be charged, so that the energy consumption will be necessarily minimized.

Further, the resistor 10 inserted in the circuit of the power source battery 2 and the selective switch means 8, 91, etc. is a limiting resistor to prevent any excess current to the gates of the SCRs.

As described above, the variable electronic flash light equipments of the invention feature the advantage that the desired quantity of flash light can be obtained stepwise by simple wiring circuits adding only a few parts to the circuits of electronic flash light equipments having a fixed quantity of flash light, and also reduces the consumption electricity; furthermore these circuits have excellent stability and durability.

In the present invention, the selective switching-on and off of the selective switch means can easily be done not only by manual operation, but also by having said switching operation coupled to the other operational members such as a focusing member of lenses or a film speed setting member, and in the latter case, a proper flash action can be automatically performed in accordance with distance or film speed. In FIG. 1 for example, if an electronic switch is arranged in series with main capacitor 6 and the capacities of both main capacitor 6 and secondary capacitor 61 are made different from one another, three-step switching of the flash light quantity can be performed, and a similar arrangement can be provided in the embodiment illustrated in FIG. 2 and thereby the variable steps of flash light quantity can be further increased.

In the present invention, when the respective capacity of capacitors **6, 61, 62–6*n* different from one another, even if selective switches 91, 92–9*n* are used, like a simple rotary switch for example, selecting an alternative state of either open or closed circuit or switching-on, a different quantity of flash light becomes obtainable according to the different selection thereof, and consequently the number of the variable steps of flash light quantity can be increased easily and considerably. In case that an alternatively selective switch as described above is used and electronic switches are provided respectively to all the capacitors arranged in parallel (i.e. the function thereof is similar to that in the case that main capacitor 6** were removed), the selective switch may be an alternatively selective switch which will never be in the state that all the circuits are fully opened.

What is claimed is:

1. An electronic flash apparatus for outputting a selectively variable discharge illumination, comprising:

a flash lamp;

a power source;

trigger means operable for causing an illumination generating discharge of said lamp;

a main capacitor disposed in parallel connection to said lamp and said power source for storing a primary electric charge and for supporting illumination-generating discharge of said lamp upon operation of said trigger means;

at least one circuit disposed in parallel connection to said main capacitor and said lamp and comprising a series-connected silicon controlled rectifier and secondary capacitor, said circuit being actuatable for selectively storing a secondary electric charge in said secondary capacitor; and selectively operative switch means for actuating said circuit to cause a secondary electric charge to be stored in said secondary capacitor for application with said primary charge to said lamp upon operation of said trigger means, such that the electric charge available for supporting discharge of said lamp may be varied from that normally provided by said main capacitor by selective actuation of said circuit to thereby increase the amount of illumination produced by said lamp by an amount corresponding to the electric charge stored in said secondary capacitor, and such that no electric charge is stored in said secondary capacitor absent actuation of said circuit to thereby conserve the capacity of said power source and promote efficient operation of said apparatus for flash lamp illumination.

2. In an electronic flash apparatus in accordance with claim 1, a plurality of said circuits, and said switch means being operative to selectively actuate one or more of said circuits to thereby provide a broad range of variation in available lamp output illumination, such that the capacity of said power source is efficiently conserved because only those secondary circuits required to provide the aggregate electric charge necessary to achieve a desired illumination are activated to cause their corresponding secondary capacitors to store an electric charge.

* * * * *